United States Patent [19]

Strassacker et al.

[11] 4,306,376

[45] Dec. 22, 1981

[54] COUNTERSUNK VASE ESPECIALLY FOR GRAVES

[75] Inventors: Ernst Strassacker, Donzdorf; Friedo Binder, Süssen; Erich Frey, Geislingen; Ludwig Ziller, Donzdorf, all of Fed. Rep. of Germany

[73] Assignee: Ernst Strassacker KG, Süssen, Fed. Rep. of Germany

[21] Appl. No.: 159,479

[22] Filed: Jun. 16, 1980

[30] Foreign Application Priority Data

Feb. 4, 1980 [DE] Fed. Rep. of Germany ..... 3012769

[51] Int. Cl.[3] ..... A47G 7/00

[52] U.S. Cl. ..... 47/41.1; 248/346

[58] Field of Search ..... 47/41, 41.1; 248/346

[56] References Cited

U.S. PATENT DOCUMENTS

| | | | |
|---|---|---|---|
| 2,099,329 | 11/1937 | Comstock et al. | 47/41.1 |
| 2,102,924 | 12/1937 | Thomas | 47/41.1 |
| 3,229,948 | 1/1966 | King | 47/41.1 X |
| 3,377,043 | 4/1968 | King | 47/41.1 X |
| 3,434,235 | 3/1969 | Gordon et al. | 47/41.1 |

*Primary Examiner*—Robert E. Bagwill
*Attorney, Agent, or Firm*—Craig and Antonelli

[57] ABSTRACT

A countersunk vase of the type used for graves has a vase mounted for raising and lowering from a hole and an arrangement for holding the vase in a raised position including an apertured fastening plate, through which the vase is raised and lowered, and stay projections on the vase. Additionally, the vase is provided at a lower end with a stop collar of larger diameter than the diameter of the aperture of the apertured fastening plate, and at least two of the above-noted stay projections are positioned in a plane located above the stop collar on the periphery of the vase to engage against the fastening plate for supporting the vase in a raised position and for passing through recesses formed on the inner circumference of the aperture of the fastening plate for lowering thereof. In accordance with a preferred embodiment, the vase has a flower divider secured in its head by a bayonet arrangement and which has holes that allow engagement of fingers of a user therethrough for the purpose of manipulating the vase for effectuating raising and lowering thereof.

12 Claims, 3 Drawing Figures

COUNTERSUNK VASE ESPECIALLY FOR GRAVES

BACKGROUND AND SUMMARY OF THE INVENTION

The invention relates to a countersunk vase, especially for graves, provided with an anti-theft device, that in the drawn-out position stands with its foot on a fastening plate which has a hole through which the vase can be countersunk.

Such countersunk vases are known. The fastening plate is of such a design that the foot of the vase engages in it like a bayonet connection. For lowering the vase, the bayonet connection is released, the vase is turned over and thrust downward with its head, through the fastening plate. The foot of the vase which is now pointing upward is again connected with the fastening plate by the bayonet connection. For security against theft, this known vase is provided with a chain which is fastened fixedly to the vase by one end and with the other end it is suitably fixed in the ground.

Countersunk vases of this kind have their drawbacks. To obtain a good fixing of the vase, the edge that receives the bayonet connection must be relatively high. This means that when the grass is mowed, the mower cannot simply be driven over the fastening plate if damage to the blade is to be avoided.

It is also a disadvantage that the vase is cumbersome to handle because the chain that is provided as security against theft is fixed to the vase and turning the vase over is made difficult. Besides, to sink the vase, it must be completely emptied, i.e., the flower water has to be poured out. Besides, a chain cannot provide adequate security against theft of the vase because such chains can be easily separated with a suitable tool, and use of very strong chains would have a poor effect on the appearance of the vase, and this should be avoided on graves.

The invention is thus concerned with the problem of making a theft-proof vase in such a way that the fastening plate that supports it will be low to the ground, and that the vase nonetheless can be simply and easily countersunk.

This object is achieved in accordance with a preferred embodiment of the invention in that the vase is provided on its foot with a stop collar whose diameter is larger than the diameter of the hole in the fastening plate, and in that in a plane above the stop collar there is provided at least two stay projections on the periphery of the vase, wherewith recesses are associated on the inner circumference of the hole.

By the construction of the stop collar on the foot of the vase with a larger diameter than that of the hole in the fastening plate, there is the effect that after anchoring the fastening plate with the ground, the foot of the vase can no longer be drawn out above the fastening plate, and the vase is absolutely protected against theft. By the arrangement of at least two stay projections on the periphery of the vase, provided in a plate above the stop collar, with recesses associated therewith on the inner circumference of the hole, there is the effect that the vase no longer has to be turned over for countersinking because the stay projections that support it can be brought to a covering position by turning the vase with the recesses in the fastening plate and thereby the vase can be lowered. To pull the vase out, the vase is again turned in such a way that the stay projections are beneath the recesses, and then it is pulled upward. After a further rotation of the vase, the stay projections are fixed on the inner edge of the fastening plate and hold the vase above it. Since the fastening plate requires no supplementary retaining devices, its height above the ground can be kept very low.

In a particularly advantageous embodiment of the invention, it is provided that the fastening plate will have a somewhat larger internal diameter than the external diameter on the head of the outer vase, and a downwardly directed retaining ring on which a protective sleeve is disposed, said sleeve advantageously being made of plastic. Hereby the sunken vase can be entirely let into the ground without having its upper edges protrude above the upper edge of the fastening plate. The plastic protective sleeve disposed on a retaining ring below the fastening plate protects the space into which the vase is sunk, from ground moisture and corrosion. In addition, it ensures that in the pulled-out position of the vase no dirt or earth fragments can penetrate into the cavity below the fastening plate.

It is further provided that the vase will have a flower divider secured in the head of the vase like a bayonet connection, and provided with holes that allow engagement of the fingers therethrough. The bayonet connection of the vase can have the effect that by simple release of the bayonet connection the flower divider can be taken out and an inner vase below it that holds the water for the flowers can be readily withdrawn to pour off dirty water. The flower divider has holes that allow engagement of the fingers therethrough so that it can be used not only for holding flowers but also it allows penetration of the fingers for the necessary turning motions to lower or pull up the vase.

As another very advantageous embodiment of the invention, it is provided that on the vase there will be retaining projections in its upper part, that can be guided through the recesses in the fastening plate, said projections being staggered above the stay projections. The effect here is that the vase can be completely sunk by only two successive turning motions. This has the advantage that somebody not familiar with the functioning of the vase who attempts, for example, to lower the vase by gripping its outer edge will have sufficient protection for his fingers, because the sunken retaining projections will hold the vase before it disappears into the fastening plate and there will be no danger of pinching one's fingers.

Additionally, an inner vase is provided that holds the water for the flowers and is applied with its upper collar-like edge on a circular projection provided on the inside of the outer vase, at its head. This has the advantage that the inner vase can be taken out very easily and thus water can be renewed from time to time.

It is further provided that the fastening plate is fixedly connected with the base, which is advantageously a stone or concrete plate, by means of a bolt countersunk therein. This anchoring of the fastening plate in the stone or concrete base has the result that after anchoring the vase cannot be withdrawn. This has the effect that there is no need for supplementary fastening means such as chains or the like because the stop collar disposed on the foot of the outer vase cannot be taken through the hole in the fastening plate because of its larger diameter, but rather it is applied with its upper edge against the underside of the fixedly mounted fastening plate.

A diametric arrangement of the stay projections and the recesses associated with them on the inner circumference of the hole offers the advantage that two such projections suffice to hold the vase in an axial direction above the fastening plate so that it cannot tip.

In a preferred embodiment of the invention, it is further provided that the flower divider will have at least two recesses with which lock projections on the inner circumference of the vase head are associated. This has the effect that the flower divider can be inverted over the lock projections and thereafter by a turning of the flower divider a bayonet-like connection will join the flower divider with the vase. This has the advantage that flowers inserted in the holes of the flower divider will have a secure seat and the vase can be turned via the flower divider for lowering or pulling it up.

It is further provided that the stay projections be disposed axially in the upper third of the vase. Thereby visual design can be achieved because it becomes possible to set the vase at two sharply differing heights above the ground, and in connection with various types of flowers, a height can be chosen which achieves the more attractive arrangement.

It is also provided that stops be disposed on the fastening plate, whereof one is to the right in the peripheral direction and the other at a greater peripheral distance to the left with reference to the recess in the fastening plate. This prevents excessive turning of the vase with reference to the fastening plate because the swing range of the vase is limited by the stops.

These and further obects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
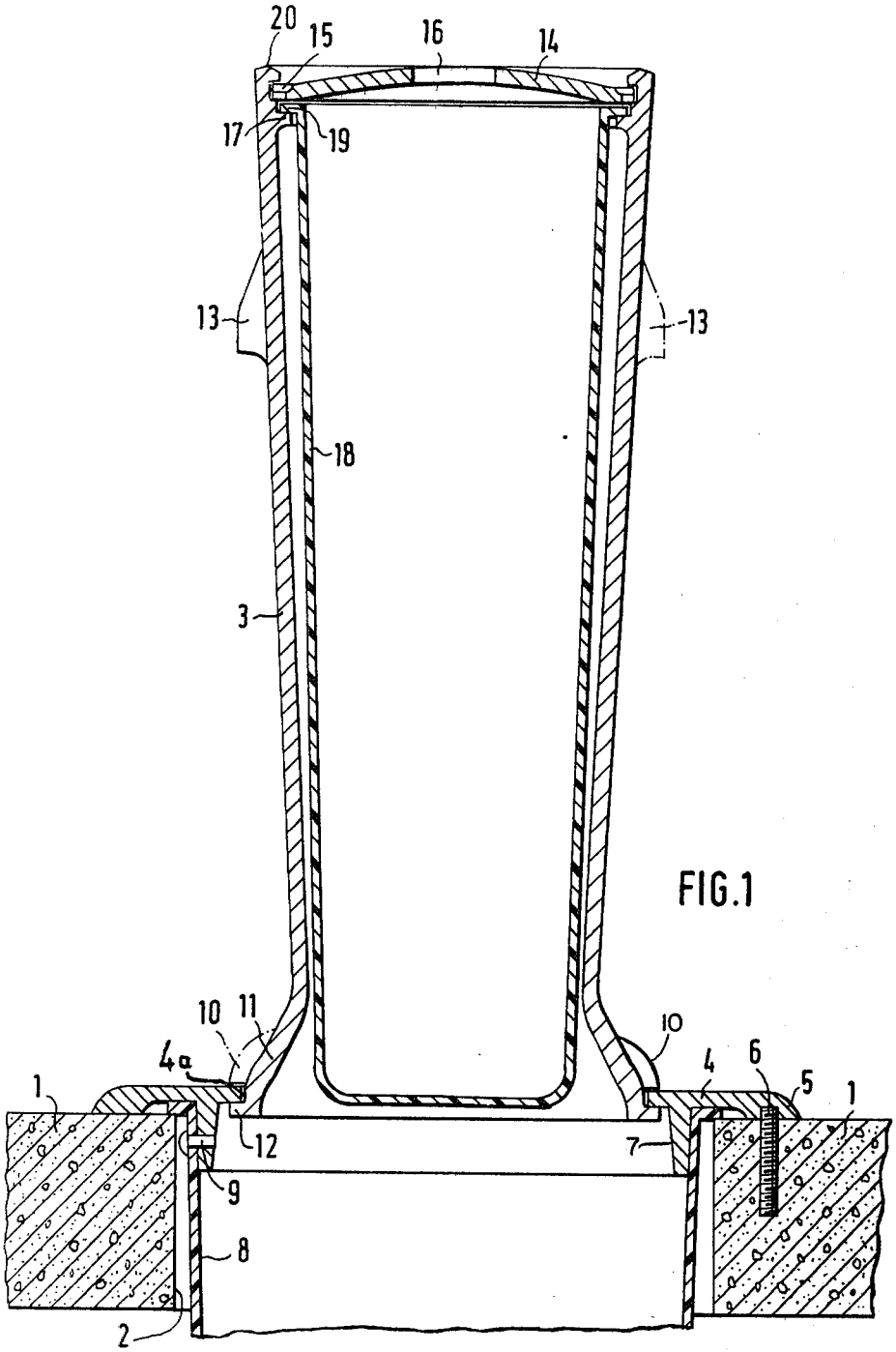
FIG. 1 shows a cross section through a vase constructed in accordance with the invention in a raised position.

In FIG. 1 a vase designed according to the invention is shown in cross section, held in a raised position. Also shown is a base plate in the form of a stone plate 1 having a hole 2 above which an outer vase 3 with a circular fastening plate 4 is held. Fastening plate 4 also has a hole 4*a* in its center, and is applied to the stone plate at its edge 5. Edge 5 is turned down toward the stone plate and is anchored in the said stone plate 1 by bolt 6 so as to be fixedly connected therewith. Fastening plate 4 also has an annular ring 7 which extends into hole 2 of stone plate 1. A plastic protective sleeve 8 protects the space below hole 2 and is fastened on ring 7 by rivets 9. The outer vase 3 is held by diametrically opposed stay projections 10 that extend outwardly from foot 11 of the vase, above fastening plate 4.

Foot 11 is provided with a stop collar 12 that has an external diameter that is greater than the internal diameter of hole 4*a* in fastening plate 4 and abuts th underside of fastening plate 4 in the raised position of FIG. 1. A complete withdrawal of vase 3 above fastening plate 4 is therefore impossible after the anchoring of bolt 6 in base plate 1. The thickness of fastening plate 4 in the region of hole 4*a* is so selected that it is somewhat less than the distance between stop collar 12 and the lower surface of stay projections 10. Since this distance is kept rather small, fastening plate 4 can be so designed that it will extend only a very small distance above base 1.

In the upper region of vase 3, there are two diametrically opposed retaining projections 13 that are shifted laterally with reference to stay projections 10. A flower divider 14 is provided as a cover for vase 3, said divider being secured by a bayonet-like connection via two lock projections 15. Between the edge of flower divider 14 and a collar 17 that has a circular inner edge of a diameter corresponding to the inner diameter of the outer vase 3 at its middle, there is disposed a plastic inner vase 18 having an upper edge 19 in the form of a collar on the inside of outer vase 3. Flower divider 14 has an upwardly bulged surface that has a highest arching point that reaches the height of the upper edge of vase 3.

Figure 3:
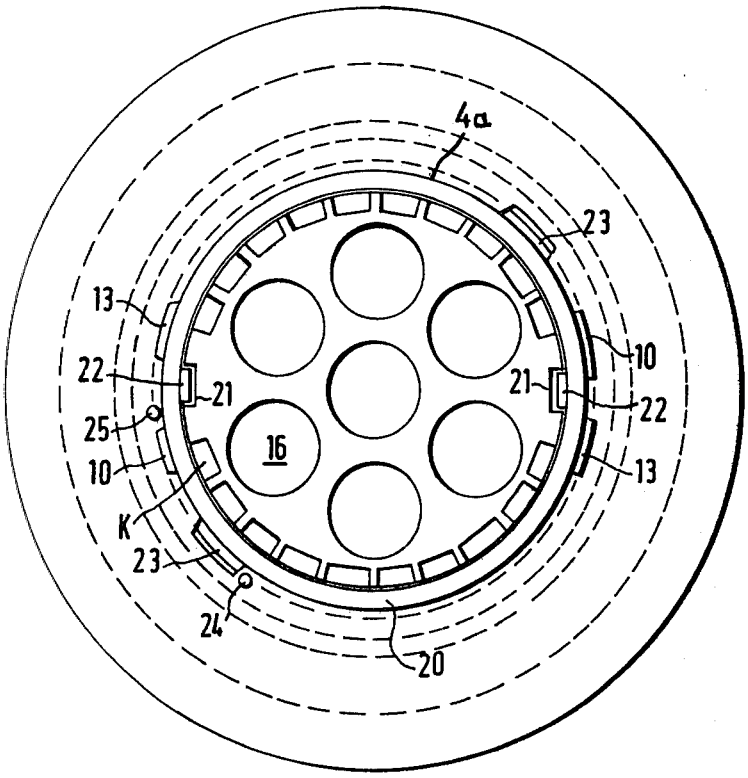
FIG. 3 is a top view of the vase of FIG. 1.

The top view of the vase with its retainers in FIG. 3 shows a plurality of holes 16 in flower divider 14 which can serve to accept flowers and to act as engaging holes if vase 3 is to be lowered. On its edge, flower divider 14 has a plurality of tooth-like notches K and two opposite bayonet recesses 21 which allow fixation of the flower divider 14 via two lock projections 22 on the upper edge 20 of vase 3.

The mutually opposed retaining projections 13 are shifted at an angle to the stay projections 10 on the base of the vase, and are respectively at different angles with reference to two recesses 23 on the retaining plate.

If vase 3 is to be lowered, after engaging the holes 16, the vase is turned until stay projections 10 are above recesses 23 and can be guided therethrough. Thereby vase 3 can be lowered without supplementary turning only until retaining projections 13 are seated on fastening plate 4. Pinching of the operator's fingers is thus impossible. Then, with renewed turning, retaining projections 13 align with recesses 23, and the vase can be completely sunken. By means of two stops 24, 25, the range of swing of vase 3 with respect to fastening plate 4 with fixedly seated projections 10 or 13 is so limited that no large movements of rotation are needed to sink the vase.

Figure 2:
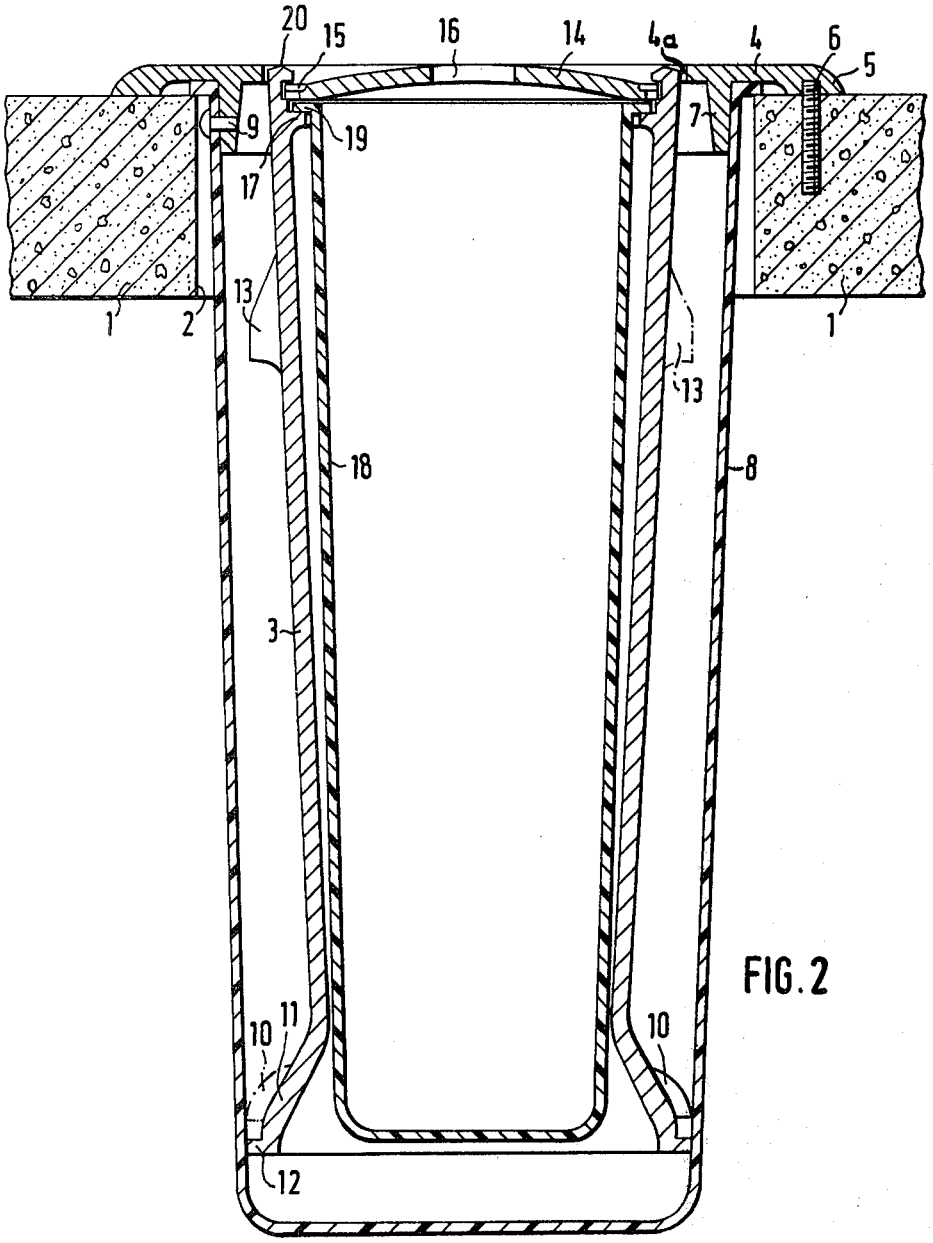
FIG. 2 shows a cross section through the vase of FIG. 1 in a lowered position.

FIG. 2 shows the vase in its sunken position, where it is lowered so far that the upper edge of fastening plate 4 coincides with the plane of the upper edge of the vase and the highest curvature of the flower divider. Due to the tapering of sleeve 8, the stop collar 12 on foot 11 of vase 3 is applied with its side to the inside of plastic protective sleeve 8 and thus prevents further lowering of vase 3.

While we have shown and described one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A countersunk vase of the type used for graves, comprising a vase mounted for raising and lowering from a hole, and means for holding the vase in a raised position including an apertured fastening plate, through which said vase is raised and lowered, and stay projections on said vase, characterized in that the vase is provided at a lower end with a stop collar of larger diameter than the diameter of the aperture of the apertured fastening plate, in that at least two of said stay projections are positioned in a plane located above the stop collar on the periphery of the vase and in that recesses are provided on the inner circumference of said aperture through which said projections are passable.

2. A countersunk vase as in claim 1, wherein said aperture has a larger diameter than the external diameter at a head of the vase and said fastening plate is provided with a downwardly directed retaining ring whereon a plastic protective sleeve is disposed.

3. A countersunk vase as in claim 2, wherein the vase has a flower divider secured in the head of the vase by a bayonet arrangement, said flower divider being provided with holes that allow engagement of fingers therethrough.

4. A countersunk vase as in claim 3, wherein lock projections are provided on the inner circumference of the vase for retaining the flow divider, said flow divider having at least two recesses through which said lock projections on the inner circumference of the vase are passable for releasing said flower divider from said vase.

5. A countersunk vase as in claims 3 or 4, comprising an inner vase removably suspended between the flower divider and a collar on an upper edge of the outer vase.

6. A countersunk vase as in claim 1, comprising retaining projections, that can be guided through the recesses in the aperture of the fastening plate, disposed on an upper part of the vase and staggered peripherally above the stay projections.

7. A countersunk vase as in claim 6, wherein said retaining projections have a bearing surface for supporting said vase, said bearing surface being located in the upper third of the vase.

8. A countersunk vase as in claim 1, wherein one of the stay projections and the fastening plate aperture recesses is located diametrically opposite another of the stay projections and recesses.

9. A countersunk vase as in claims 1 or 2 or 3 or 6 or 8, wherein the fastening plate is connected fixedly with a base by a bolt countersunk in said base, said base being a stone or concrete plate.

10. A countersunk vase according to claim 9, wherein said base is embedded in the ground.

11. A countersunk vase as in claim 9, comprising stops provided on the fastening plate, one of said stops being disposed peripherally to the right of one of the recesses in the aperture of the fastening plate, and one of said stops being disposed at a peripheral distance to the left of another of said recesses, said peripheral distance to the left being greater than said peripheral distance to the right.

12. A countersunk vase according to claim 1, wherein said base is embedded in the ground.

* * * * *